US007750242B2

(12) United States Patent
Fukuchi et al.

(10) Patent No.: US 7,750,242 B2
(45) Date of Patent: Jul. 6, 2010

(54) INSULATED WIRE, INSULATED CABLE, NON-HALOGEN FLAME RETARDANT WIRE, AND NON-HALOGEN FLAME RETARDANT CABLE

(75) Inventors: Katsuichi Fukuchi, Hitachi (JP); Masami Sorimachi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 247 days.

(21) Appl. No.: 12/129,271

(22) Filed: May 29, 2008

(65) Prior Publication Data

US 2008/0296041 A1 Dec. 4, 2008

(30) Foreign Application Priority Data

May 31, 2007 (JP) ..... 2007-145753
May 31, 2007 (JP) ..... 2007-145754

(51) Int. Cl.
*H01B 11/06* (2006.01)

(52) U.S. Cl. ..... 174/110 R; 174/36; 174/120 R

(58) Field of Classification Search ..... 174/110 R, 174/110 SR, 110 N, 110 FC, 110 E, 120 R, 174/120 C, 12 AR, 126.1, 126.2; 428/379, 428/372, 383

See application file for complete search history.

(56) References Cited

U.S. PATENT DOCUMENTS

| | | | | |
|---|---|---|---|---|
| 5,286,564 | A | 2/1994 | Cecchin et al. | |
| 6,087,443 | A * | 7/2000 | Sadatoshi et al. | 525/88 |
| 6,372,344 | B1 * | 4/2002 | Castellani et al. | 428/379 |
| 7,084,347 | B2 * | 8/2006 | Mhetar et al. | 174/110 R |
| 2006/0131059 | A1 * | 6/2006 | Xu et al. | 174/117 F |

FOREIGN PATENT DOCUMENTS

| | | |
|---|---|---|
| JP | 6-25367 | 2/1994 |
| JP | 2006-505685 | 2/2006 |
| JP | 2006-241225 | 9/2006 |
| WO | WO 2004/041928 A1 | 5/2004 |

* cited by examiner

*Primary Examiner*—William H Mayo, III
(74) *Attorney, Agent, or Firm*—Scully, Scott, Murphy & Presser, P.C.

(57) ABSTRACT

A metallic conductor and an insulator provided at an outer periphery of the metallic conductor for coating the metallic conductor constitutes an insulated wire or cable. The insulator has a reactor blended type polyolefin-based thermoplastic resin containing 51-85 mol % per monomer unit of the crystalline polypropylene. In the insulator used in a non-halogen flame retardant wire or cable, 40 to 300 pbw of a metallic hydroxide is added to 100 pbw of a blended composition. In the blended composition, the reactor blended type polyolefin-based thermoplastic resin containing 51-85 mol % per monomer unit of the crystalline polypropylene is greater than 50 pbw and less than 100 pbw, and a polyolefin is greater than 0 pbw and not greater than 50 pbw.

20 Claims, 1 Drawing Sheet

INSULATED WIRE, INSULATED CABLE, NON-HALOGEN FLAME RETARDANT WIRE, AND NON-HALOGEN FLAME RETARDANT CABLE

The present application is based on Japanese Patent Application Nos. 2007-145753 and 2007-145754, the entire contents of which are incorporated herein by reference.

BACKGROUND OF THE INVENTION

1. Field of the Invention

The present invention relates to an insulated wire and an insulated cable, more particularly, to an insulated wire and an insulated cable with excellent oil resistance property and flexibility using a thermoplastic elastomer.

Further, the present invention relates to a non-halogen flame retardant wire and a non-halogen flame retardant cable, more particularly, to a non-halogen (halogen free) flame retardant wire and a non-halogen (halogen free) flame retardant cable with excellent oil resistance property and flame retardant property.

2. Related Art

In recent years, as an insulator to be coated on the electric wire or cable, an insulator comprising a thermoplastic elastomer has been used. It is because that the thermoplastic elastomer is advantageous as compared to a rubber since the thermoplastic elastomer can be used at a high temperature without requiring a crosslinking process. The thermoplastic elastomer is further advantageous in that it is possible to supply the electric wire or cable with low cost and high recyclable property, since the cross linking process is not required.

For the electric wires and cables, heat resistance property, oil resistance property, flexibility, wiring property, and the like are required. Accordingly, it is impossible to satisfy these properties by a single kind of polyolefin constituting the thermoplastic elastomer that is a material of the insulator for the electric wires and cables. Namely, when using only crystalline polyolefin, thermoplastic elastomer thus obtained is excellent in the heat resistance property and the oil resistance property. However, it is impossible to obtain the flexibility equivalent to that of conventional soft PVC. On the other hand, when using only amorphous polyolefin, the obtained thermoplastic elastomer is excellent in the flexibility. However, it is impossible to obtain the heat resistance property and the oil resistance property.

Therefore, a blended composition of different kinds of polyolefins having different properties such as the crystalline polyolefin and the amorphous polyolefin is used for obtaining a thermoplastic elastomer excellent in the heat resistance property, the oil resistance property, and the flexibility.

Blending techniques for the thermoplastic elastomer are roughly classified into (1) simple blending type, (2) dynamic crosslinking type, and (3) reactor blending type.

(1) The simple blending type is to mix two or more kinds of elastomers after mechanically shearing the elastomers by a mixer. (2) The dynamic crosslinking type is to add a crosslinking process when blending the elastomer serving as a disperse phase with the elastomer serving as a matrix phase, in order to agglomeration of the disperse phase. (3) The reactor blending type is to blend resin components generated at respective stages in a reactor at time of polymerization when manufacturing by the multi-stage polymerization.

In general, when the polyolefins having different characteristics are blended with each other, the blended composition has a sea-island structure wherein one polyolefin serves as a sea phase and another polyolefin serves as an island phase. At this time, compatibility of advantages of the polyolefins having different characteristics is increased in accordance with reduction in diameter of the disperse phase serving as the island phase. However, mutual solubility in blending the polyolefins having different characteristics is low, so that it was difficult to miniaturize the disperse phase.

For example, (1) simple blended type thermoplastic elastomer has the sea-island structure, in which the disperse phase is largely dispersed in the matrix phase. In (2) dynamically crosslinked type thermoplastic elastomer, the agglomeration of the disperse phase is prevented and the diameter of the disperse phase is reduced, by adding the crosslinking process. However, the disperse phase is dispersed largely in the matrix phase, so that the properties of the polyolefin serving as the matrix phase are dominant. Therefore, it is difficult to utilize the properties of the polyolefin serving as the disperse phase. Since (3) reactor blended type thermoplastic elastomer is manufactured by the multi-stage polymerization, it is possible to finely disperse the amorphous polyolefin serving as the disperse phase in the crystalline polyolefin serving as the matrix phase, compared to the (1) simple blended type thermoplastic elastomer and the (2) dynamically crosslinked type thermoplastic elastomer. However, it was difficult to disperse the amorphous polyolefin so finely that the oil resistance property of the crystalline polyolefin and the flexibility of the amorphous polyolefin in the blended composition of a conventional reactor blended type thermoplastic elastomer.

In particular, for electric wires and cables, the flame retardant property and the oil resistance property are required. Accordingly, a crosslinked chloroprene rubber has been used as the insulator to be coated on the electric wires and the cables. It is because that the crosslinked chloroprene rubber contains high polarity chlorine in its composition, and is excellent in the oil resistance property particularly in the mineral oil resistance property. Further, the crosslinked chloroprene rubber is excellent in the flame retardant property, since the crosslinked chloroprene rubber discharges the chlorine to suppress the inflammation of the insulator. Therefore, the crosslinked chloroprene rubber has been used as an oil resistance and flame retardant rubber.

From the point of view of escalation in interest with respect to the environment in recent years, the electric wires and cables coated with insulator comprising a non-halogen composition that does not discharge a harmful halogen gas to an atmosphere in combustion has been requested. However, since the crosslinked chloroprene rubber is crosslinked and further contains the chlorine, the crosslinked chloroprene rubber has not been used as a non-halogen material and a recyclable material.

Therefore, as an insulator to be coated on the electric wire or cable, an insulator comprising a non-halogen type thermoplastic elastomer has been used to provide the insulator with the halogen free property and the recyclable property. It is because that the non-halogen type thermoplastic elastomer is advantageous as compared to the crosslinked chloroprene rubber since the non-halogen type thermoplastic elastomer can be used at a high temperature without requiring a crosslinking process. The non-halogen type thermoplastic elastomer is further advantageous in that it is possible to supply the electric wire or cable with low cost and high recyclable property, since the cross linking process is not required.

As a related art, Japanese patent laid-open No. 6-25367 discloses that the olefin-based composition using the reactor blending type (3) is excellent in the flexibility. Japanese patent laid-open No. 2006-241225 discloses the thermoplastic elastomer excellent in the flexibility, the damage resistance property, and the tensile property, which is applicable to the insulator for the electric wire. Japanese publication No. 2006-505685 of translation for International publication discloses the thermoplastic olefin-based composition excellent in the heat resistance property and the tensile strength that is applied to the insulator for the electric wire. Japanese patent laid-open No. 2006-505685 discloses the thermoplastic olefin-based composition excellent in the heat resistance property and the tensile strength, which is applicable to the insulator for the electric wire.

SUMMARY OF THE INVENTION

Therefore, it is an object of the present invention to provide an insulated wire and an insulated cable having excellent oil resistance property and flexibility.

It is another object of the present invention to provide a non-halogen flame retardant wire and a non-halogen flame retardant cable having excellent oil resistance property and flame retardant property.

According to a first feature of the invention, an insulated wire comprises:

a metallic conductor; and an insulator provided at an outer periphery of the metallic conductor for coating the metallic conductor, the insulator comprising a reactor blended type polyolefin-based thermoplastic resin containing 51-85 mol % per monomer unit of a crystalline polypropylene.

In the insulated wire, it is preferable that a bending elastic modulus of the insulator is not more than 20 MPa.

In the insulated wire, the insulator may further comprise an olefin-based polymer blended with the reactor blended type polyolefin-based thermoplastic resin.

According to a second feature of the invention, an insulated cable comprises:

a metallic conductor, and an insulator provided at an outer periphery of the metallic conductor for coating the metallic conductor, the insulator comprising a reactor blended type polyolefin-based thermoplastic resin containing 51-85 mol % per monomer unit of a crystalline polypropylene.

In the insulated cable, it is preferable that a bending elastic modulus of the insulator is not more than 20 MPa.

In the insulated cable, the insulator may further comprise an olefin-based polymer blended with the reactor blended type polyolefin-based thermoplastic resin.

According to a third feature of the invention, a non-halogen flame retardant wire comprises:

a metallic conductor; and an insulator provided at an outer periphery of the metallic conductor for coating the metallic conductor, the insulator comprising 100 pbw of a blended composition and 40 to 300 pbw of a metallic hydroxide, the blended composition comprising greater than 50 pbw and less than 100 pbw of a reactor blended type polyolefin-based thermoplastic resin containing 51-85 mol % per monomer unit of a crystalline polypropylene, and greater than 0 pbw and not greater than 50 pbw of a polyolefin.

In the non-halogen flame retardant wire, it is preferable that the reactor blended type polyolefin-based resin is 60 to 90 pbw and the polyolefin is 5 to 40 pbw in the blended composition.

In the non-halogen flame retardant wire, the polyolefin may comprise at least one of a crystalline rubber and a polar rubber.

According to a fourth feature of the invention, a non-halogen flame retardant cable comprises:

a metallic conductor; and an insulator provided at an outer periphery of the metallic conductor for coating the metallic conductor, the insulator comprising 100 pbw of a blended composition and 40 to 300 pbw of a metallic hydroxide, the blended composition comprising greater than 50 pbw and less than 100 pbw of a reactor blended type polyolefin-based thermoplastic resin containing 51-85 mol % per monomer unit of the crystalline polypropylene, and greater than 0 pbw and not greater than 50 pbw of a polyolefin.

In the non-halogen flame retardant cable, it is preferable that the reactor blended type polyolefin-based resin is 60 to 90 pbw and the polyolefin is 5 to 40 pbw in the blended composition.

In the non-halogen flame retardant cable, the polyolefin may comprise at least one of a crystalline rubber and a polar rubber.

The insulated wire may further comprise a sheath layer for coating an outer periphery of the insulator.

The insulated cable may further comprise a sheath layer for coating an outer periphery of the insulator.

The non-halogen flame retardant wire may further comprise a sheath layer for coating an outer periphery of the insulator.

The non-halogen flame retardant cable may further comprise a sheath layer for coating an outer periphery of the insulator.

In the insulated wire, the metallic conductor may comprise a plurality of metallic conductors each coated with the insulator and stranded with each other.

In the insulated cable, the metallic conductor may comprise a plurality of metallic conductors each coated with the insulator and stranded with each other.

In the non-halogen flame retardant wire, the metallic conductor may comprise a plurality of metallic conductors each coated with the insulator and stranded with each other.

In the non-halogen flame retardant cable, the metallic conductor may comprise a plurality of metallic conductors each coated with the insulator and stranded with each other.

According to the present invention, it is possible to obtain the insulated wire and the insulated cable having the excellent oil resistance property and the flexibility.

Further, it is possible to obtain the a non-halogen flame retardant wire and a non-halogen flame retardant cable having excellent oil resistance property and flame retardant property.

BRIEF DESCRIPTION OF THE DRAWINGS

Next, preferred embodiments according to the present invention will be explained below in conjunction with appended drawings, wherein.

DETAILED DESCRIPTION OF THE PREFERRED EMBODIMENTS

Next, preferred embodiments of the present invention will be described below in more detail in conjunction with the appended drawings.

Firstly, the Inventors contemplated that the thermoplastic elastomer to be coated as the insulator on a metallic conductor is required to be excellent in the oil resistance property and the flexibility, in order to obtain the insulated wire and the insulated cable in which the oil resistance property and the flexibility are compatible with each other.

After various studies, it is found that it is possible to obtain a desired thermoplastic elastomer by using the reactor blended type polyolefin-based thermoplastic resin as a base. Further, it is found that it is possible to realize the oil resistance property as well as the flexibility in the reactor blended type polyolefin-based thermoplastic elastomer to be used for the electric wire and cable, by determining a content of a crystalline polypropylene that is excellent in the heat resistance property and the oil resistance property within a predetermined range (51 to 85 mol % per monomer unit) in the reactor blended type polyolefin-based thermoplastic resin.

Based on these findings, the best mode for carrying out the invention will be explained below. The preferred embodiments are shown as examples, and several variations are possible without going beyond the scope of the technical idea of the present invention.

Secondly, the Inventors contemplated that the thermoplastic elastomer to be coated as the insulator on the metallic conductor is required to be excellent in the oil resistance property and the flexibility, in order to obtain the non-halogen flame retardant wire and the non-halogen flame retardant cable, in which the oil resistance property and the flexibility are compatible with each other.

After various studies, it is further found that it is possible to realize the oil resistance property as well as the flame retardant property in the reactor blended type polyolefin-based thermoplastic elastomer to be used for as the non-halogen flame retardant wire and the non-halogen flame retardant cable, by determining a content of a propylene which is a crystalline polypropylene that is excellent in the heat resistance property and the oil resistance property within a predetermined range and adding the polyolefin and the metallic hydroxide at a predetermined composition ratio to the reactor blended type polyolefin-based thermoplastic resin.

Based on these findings, the best mode for carrying out the invention will be explained below. The preferred embodiments are shown as examples, and several variations are possible without going beyond the scope of the technical idea of the present invention.

First Preferred Embodiment

Figure 1:
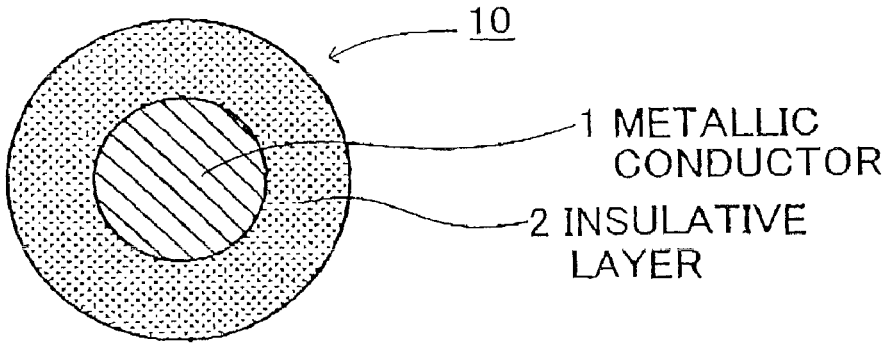
FIG. 1 is a cross sectional view of an insulated wire or cable in a preferred embodiment according to the present invention.

FIG. 1 is a cross sectional view of the insulated wire or the insulated cable in a first referred embodiment according to the present invention.

In this preferred embodiment, an insulated wire (insulated electric wire) 10 is explained, however, the present invention is not limited thereto, and the insulated cable may have the same configuration.

As shown in FIG. 1, the insulated wire 10 comprises a lengthy metallic conductor 1 having a circular cross section and an insulative layer 2 of an insulator for coating an outer periphery of the metallic conductor 1. A cross section of the insulated wire (or insulated cable) 10 is not limited to a circular shape in the present invention. The cross section of the insulated wire 10 may be rectangular. Namely, the insulated wire 10 may comprise a rectangular metallic conductor coated with the insulative layer 2, in which the rectangular metallic conductor is obtained by conducting a slit processing on a copper plate or rolling a circular wire.

It is sufficient if the insulated wire 10 comprises the metallic conductor 1 coated with the insulator (insulative layer) 2.

Second Preferred Embodiment

Figure 2:
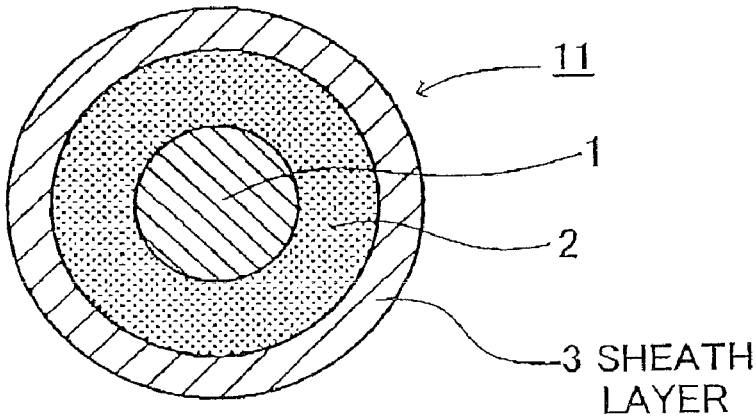
FIG. 2 is a cross sectional view of an insulated wire or cable in another preferred embodiment according to the present invention.

FIG. 2 is a cross sectional view of an insulated wire or cable in another preferred embodiment according to the present invention. In this preferred embodiment, the insulated wire (or the insulated cable) 11 comprises a metallic conductor 1, an insulative layer 2 for coating an outer periphery of the metallic conductor 1, and a sheath layer 3 for coating an outer periphery of the insulative layer 2.

Third Preferred Embodiment

Figure 3:
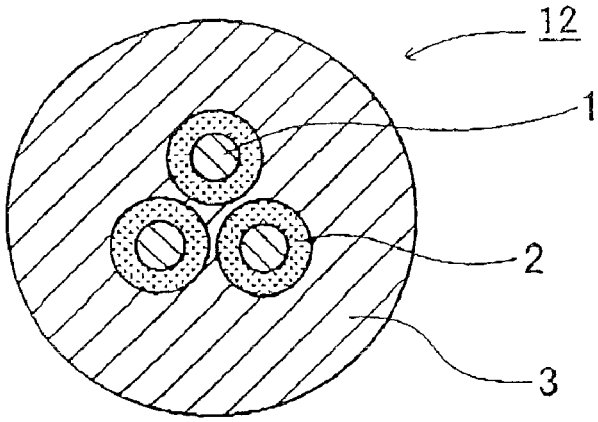
FIG. 3 is a cross sectional view of an insulated wire or cable in a still another preferred embodiment.

FIG. 3 is a cross sectional view of an insulated wire or cable in a still another preferred embodiment. In this preferred embodiment, a plurality of metallic conductors 1 each coated with the insulative layer 2 are stranded with each other and coated with a sheath layer 3 at their outer peripheries.

As a material of the metallic conductor 1, for example, copper may be used. The metallic conductor 1 may comprise a single copper wire. The metallic conductor 1 may comprise a stranded wire or a braided wire comprising a plurality of copper wires. The copper wire may be tin-plated by hot-dip plating or electrolytic plating.

As a material of the sheath layer 3, for example, the reactor blended type polyolefin-based thermoplastic elastomer may be used.

As an insulative material for the insulative layer 2, a reactor blended type polyolefin-based thermoplastic resin obtained by the multi-stage polymerization method is used. As the reactor blended type polyolefin-based thermoplastic resin, a thermoplastic elastomer containing 51 to 85 mol % per monomer unit of the crystalline polypropylene is used. The thermoplastic elastomer in this preferred embodiment has excellent oil resistance property and flexibility. The thermoplastic elastomer in this preferred embodiment may contain for example $\alpha$-olefin-based polymer other than the crystalline polypropylene.

The reason for determining a composition ratio of the crystalline polypropylene within the range of 51 to 85 mol % per monomer unit in the thermoplastic elastomer in this preferred embodiment is as follows. If the composition ratio of the crystalline polypropylene exceeds 85 mol %, a bending elastic modulus serving as an index for the flexibility will exceed 20 MPa, so that it is impossible to obtain the flexibility equivalent to the soft PVC in the insulated wire or cable comprising the insulative layer 2. Accordingly, it is preferable that the bending elastic modulus of the insulated wire or cable is not greater than 20 MPa. Further, if the composition ratio of the crystalline polypropylene is less than 51 mol %, it is impossible to satisfy the oil resistance property.

By determining the composition ratio of the crystalline polypropylene within the range of 51 to 85 mol % per monomer unit in the thermoplastic elastomer, it is possible to provide an interpenetrating network structure with the reactor blended type thermoplastic elastomer without a clear sea-island structure, since the component serving as the disperse phase is finely dispersed such that the diameter of the disperse phase is not greater than 1 μm.

Therefore, the respective advantages of the polyolefins having different characteristics are compatible with each other, so that it is possible to obtain the insulated wire and the insulated cable excellent in the oil resistance property and the flexibility.

Further, as the insulative material for the insulative layer 2, a thermoplastic elastomer comprising a blended composition of the reactor blended type polyolefin-based thermoplastic resin containing 51 to 85 mol % per monomer unit of the crystalline polypropylene and other olefin-based polymer(s). By blending the reactor blended type polyolefin-based thermoplastic resin in the preferred embodiment with the other olefin-based polymer(s), it is possible to improve the oil resistance property, the flexibility, and other characteristics.

Herein, the other polyolefin-based polymers may be polyethylene, polypropylene, propylene-ethylene copolymer, ethylene-methylacrylate copolymer, ethylene-ethylacrylate copolymer, ethylene-vinyl acetate copolymer, ethylene-butene copolymer, ethylene-methyl metaacrylate copolymer, styrene-ethylenebutylene-styrene copolymer, and the like.

In addition, flame retardant agent, colorant, filler, lubricant, or the like other than the other olefin-based polymers may be added to the blended composition as long as such addition does not damage the flexibility.

(Fabrication of the Insulated Wire and the Insulated Cable)

The insulated wire and the insulated cable in the first to third preferred embodiments may be fabricated, for example, by melting and kneading the thermoplastic elastomer then extruding the thermoplastic elastomer around one or more metallic conductors with use of an ordinary extruding molding line. In the melting and kneading process, for example, a batch type mixer or a biaxial screw extruder may be used. Further, for the extruding molding line, for example, a biaxial extruder may be used. By using the biaxial extruder, the molten and kneaded thermoplastic elastomer is extruded around the metallic conductor, so that the metallic conductor is coated with the thermoplastic elastomer to provide a coating layer (insulative layer).

The insulated wire and the insulated cable are suitable for an electric wire and cable for aviation light.

Further, the reactor blended type polyolefin-based thermoplastic resin containing 51 to 85 mol % per monomer unit of the crystalline polypropylene may be processed by injection molding. Therefore, it is possible to apply the reactor blended type polyolefin-based thermoplastic resin containing 51 to 85 mol % per monomer unit of the crystalline polypropylene to a molding material, shielding material, packing material or the like.

Fourth Preferred Embodiment

The non-halogen flame retardant wire or cable in a fourth preferred embodiment has a same configuration as the insulated wire or cable shown FIG. 1.

In this preferred embodiment, the non-halogen flame retardant wire is explained, however, the present invention is not limited thereto, and the non-halogen flame retardant.

As an insulative material for the insulative layer 2, a material comprising 100 pbw (parts by weight) of a blended composition comprising greater than 50 pbw and less than 100 pbw of a reactor blended type polyolefin-based thermoplastic resin containing 51-85 mol % per monomer unit of the crystalline polypropylene and a polyolefin, to which 40 to 300 pbw of a metallic hydroxide is added, is used.

The reactor blended type polyolefin-based thermoplastic elastomer in the fourth to sixth preferred embodiments may mainly contain for example α-olefin-based polymer other than the crystalline polypropylene.

The reactor blended type polyolefin-based thermoplastic resin obtained by the multi-stage polymerization method is used. In the multi-stage polymerization method, resin components generated at respective polymerization stages are blended in a reactor for polymerization. Accordingly, compared with a simple blending method using a closed type mixer such as kneader, bambury mixer or a roller, it is possible to finely disperse the amorphous polyolefin in the crystalline polyolefin.

In particular, by determining the composition ratio of the crystalline polypropylene within the range of 51 to 85 mol % per monomer unit in the reactor blended type thermoplastic elastomer, it is possible to provide an interpenetrating network structure with the reactor blended type thermoplastic elastomer without a clear sea-island structure, since a component serving as the disperse phase is finely dispersed such that the diameter of the disperse phase is not greater than 1 μm. According to this structure, it is possible to provide a base material excellent in the oil resistance property and the flexibility in which respective advantages of the polyolefins having different characteristics are compatible with each other.

The reason for determining the composition ratio of the crystalline polypropylene within the range of 51 to 85 mol % per monomer unit in the thermoplastic elastomer in the fourth to sixth preferred embodiments is same as the reason described in the first to third preferred embodiments. If the composition ratio of the crystalline polypropylene exceeds 85 mol %, the bending elastic modulus serving as the index for the flexibility will exceed 20 MPa, so that it is impossible to obtain the flexibility equivalent to the soft PVC in the non-halogen flame retardant wire or cable comprising the insulative layer 2. Further, if the composition ratio of the crystalline polypropylene is less than 51 mol %, it is impossible to satisfy the oil resistance property cable may have the same configuration.

As shown in FIG. 1, the non-halogen flame retardant wire 10 comprises a lengthy metallic conductor 1 having a circular cross section and an insulative layer 2 of an insulator for coating an outer periphery of the metallic conductor 1. A cross section of the non-halogen flame retardant wire (or the non-halogen flame retardant cable) 10 is not limited to a circular shape in the present invention. The cross section of the non-halogen flame retardant wire 10 may be rectangular. Namely, the non-halogen flame retardant wire 10 may comprise a rectangular metallic conductor coated with the insulative layer, in which the rectangular metallic conductor is obtained by conducting a slit processing on a copper plate or rolling a circular wire.

It is sufficient if the non-halogen flame retardant wire 10 comprises the metallic conductor coated with the insulator.

Fifth Preferred Embodiment

The non-halogen flame retardant wire or cable in a fifth preferred embodiment has a same configuration as the insulated wire or cable shown FIG. 2.

In this preferred embodiment, the non-halogen flame retardant wire (or the non-halogen flame retardant cable) 11 comprises a metallic conductor 1, an insulative layer 2 for coating an outer periphery of the metallic conductor 1, and a sheath layer 3 for coating an outer periphery of the insulative layer 2

Sixth Preferred Embodiment

The non-halogen flame retardant wire or cable in a sixth preferred embodiment has a same configuration as the insulated wire or cable shown FIG. 3.

In this preferred embodiment, a plurality of metallic conductors 1 each coated with the insulative layer 2 are stranded with each other and coated with a sheath layer 3 at their outer peripheries.

As a material of the metallic conductor 12 for example, copper may be used. The metallic conductor 1 may comprise a single copper wire. The metallic conductor 1 may comprise a stranded Ore or a braided wire comprising a plurality of copper wires. The copper wire may be tin-plated by hot-dip plating or electrolytic plating.

As a material of the sheath layer 3, for example, the reactor blended type polyolefin-based thermoplastic elastomer may be used.

Further, it is necessary to use the material comprising 100 pbw of the blended composition of the reactor blended type polyolefin-based thermoplastic resin and the polyolefin, in which the reactor blended type polyolefin-based thermoplastic resin is greater than 50 pbw and less than 100 pbw and the polyolefin is greater than 0 pbw and not greater than 50 pbw. If the blended composition ratio is not within the above range, the non-halogen flame retardant wire or cable will not satisfy the oil resistance property.

Still further, by blending the polyolefin with the reactor blended type polyolefin base thermoplastic resin, it is possible to improve the flame retardant property and the oil resistance property. It is preferable that the blending ratio is within a range that the reactor blended type polyolefin-based thermoplastic resin is 60 pbw, to 95 pbw and the polyolefin is 5 to 40 pbw.

When a crystalline resin is selected as the polyolefin, a hardness of the insulative material is increased, so that the flexibility of the non-halogen flame retardant electric wire or cable using such the insulative material will be damaged. Therefore, in this case, it is preferable that 10 to 40 pbw of the polyolefin is blended with 60 to 90 pbw of the reactor blended type polyolefin-based thermoplastic resin.

Alternatively, when a polar rubber is selected as the polyolefin, it is preferable that 10 to 50 pbw of the polyolefin is blended with 50 to 90 pbw of the reactor blended type polyolefin-based thermoplastic resin.

By adding 40 to 300 pbw of flame retardant agent comprising the metallic hydroxide to 100 pbw of the blended composition of the reactor blended type polyolefin-based thermoplastic resin and the polyolefin, it is possible to provide the flame retardant property with the non-halogen flame retardant electric wire or cable using such insulative material. When the flame retardant agent is less than 40 pbw, the flame retardant property will be reduced. When the flame retardant agent is greater than 300 pbw, the flexibility and the mechanical strength will be decreased. The content of the flame retardant agent comprising the metallic hydroxide is more preferably 50 to 200 pbw.

In addition, by conducting a silane treatment on a surface of the metallic hydroxide used as the flame retardant agent, it is possible to suppress agglomeration of the metallic hydroxide when dispersed into the resin, and to increase an adhesion with the resin, thereby improving the strength of the insulative material.

By selecting at least one of the crystalline resin and the polar rubber as the polyolefin to be blended with the reactor blended type polyolefin-based thermoplastic resin, it is possible to improve the oil resistance property. As the crystalline resin, for example, polyethylene, polypropylene or the like may be used. However, the present invention is not limited thereto, and other polyolefins each having a melting point may be also used. Similarly, acrylonitrile butadiene rubber, urethane rubber or the like may be used as the polar rubber. However, the present invention is not limited thereto, and other polar rubbers each having polar groups in the molecule and having the excellent oil resistance property may be also used.

When selecting the polar rubber as the polyolefin, it is preferable to use a crosslink-dispersed polar rubber by using the closed type mixer such as the kneader, bambury mixer. Since there is a large difference in viscosity between the reactor blended type polyolefin-based thermoplastic resin and the polyolefin, the dispersion of the polar rubber is not excellent when using the simple blending method, so that it is difficult to obtain desired properties.

In addition, antioxidant agent, colorant, filler, lubricant, or the like may be added to the aforementioned resin composition as necessary.

(Fabrication of the Non-Halogen Flame Retardant Wire and the Insulated Cable)

The non-halogen flame retardant wire and the non-halogen flame retardant cable in the fourth to sixth preferred embodiments may be fabricated, for example, by melting and kneading the resin composition then extruding the resin composition around one or more metallic conductors with use of the ordinary extruding molding line. In the melting and kneading process, for example, the batch type mixer or the biaxial screw extruder may be used. Further, for the extruding molding line, for example, the biaxial extruder may be used.

By using the biaxial extruder, the molten and kneaded resin composition is extruded around the metallic conductor, so that the metallic conductor is coated with the resin composition to provide a coating layer.

The non-halogen flame retardant wire and the non-halogen flame retardant cable are suitable for the electric wire and cable for aviation light.

EXAMPLES

Next, examples in the first to third preferred embodiments according to the present invention will be explained below.

TABLE 1 shows results of evaluation tests of compositions of insulator (resin compositions) in the Examples of the first to third preferred embodiments for respective properties.

TABLE 2 shows results of evaluation tests of compositions of insulator (resin compositions) in Comparative examples for respective properties.

Samples used in the evaluation tests are manufactured by extruding molding each of the resin compositions in the Examples shown in TABLE 1 and the resin compositions in the Comparative examples shown in TABLE 2, to have a sheet-like shape with a thickness of 2 mm. For each of these samples, an initial tensile strength test, an initial tensile elongation test, a heat resistance test, an oil resistance test, a flexibility test, and a wiring property evaluation test are conducted.

Herein, each of insulated wires used in the wiring property evaluation test has a structure shown in FIG. 1. Seven copper wires are stranded to have a total outer diameter of 3.6 mm to provide a metallic conductor 1, and the metallic conductor 1 is coated with the resin composition shown in TABLE 1 and TABLE 2 by extruding molding to provide a coating layer 2 with an outer diameter of 12 mm. The wiring property evaluation test is conducted by using the insulated wire thus manufactured.

In TABLE 1 and TABLE 2, abbreviation and content of each composition is as follows.

TPO: Polyolefin-based thermoplastic resin

Reactor (blended) type TPO-A (density: 087 g/cm$^3$, MI (melt index): 7 g/10 min, crystalline polypropylene unit: 51 mol %)

Reactor type TPO-B (density: 0.87 g/cm$^3$, MI: 7 g/10 min, propylene unit: 63 mol %)

Reactor type TPO-C (density: 0.89 g/cm$^3$, MI: 7 g/10 min, propylene unit: 85 mol %)

Reactor type TPO-D (density: 0.89 g/cm$^3$, MI: 7 g/10 min, propylene unit: 45 mmol %)

Reactor type TPO-E (density: 0.89 g/cm$^3$, MI: 7 g/10 min, propylene unit: 90 mol %)

Dynamically crosslinked type TPO (density: 0.97 g/cm$^3$)

Linear low-density polyethylene (density: 0.92 g/cm$^3$, MI: 2 g/10 min)

Ethylene-vinyl acetate copolymer (vinyl acetate: 32%, MI: 0.2 g/10 min)

Random type polypropylene (density: 0.90 g/cm$^3$, MI: 11 g/10 min)

Flame retardant agent (non-decabromodiphenyl ether type bromine flame retardant agent)

Antioxidant (phenolic based antioxidant)

In addition, the measurements are conducted as follows in the evaluation tests shown n TABLE 1 and TABLE 2.

(1) Initial Tensile Strength and Tensile Elongation Tests

In accordance with JIS (Japanese Industrial Standards) C-3005, the tensile strength test for each sample was conducted at a rate of 500 mm/min by using a sheet-like sample having a thickness of 2 mm. Target values of the initial tensile strength and the initial tensile elongation are not less than 13 MPa and not less than 300%, respectively.

The tensile elongation is calculated by a following formula (a).

$$\text{Tensile elongation (\%)}=[(\text{sample length after the elongation test})-(\text{sample length before the elongation test})]\times 100/(\text{sample length before the elongation test}) \quad (a)$$

(2) Heat Resistance Test

In accordance with the JIS C-3005, after the sample used for the initial tensile strength and tensile elongation tests was exposed at a temperature of 100° C. in a constant temperature bath for 96 hours, the tensile strength and tensile elongation tests were conducted for a cooled sample, and a tensile strength retention and a tensile elongation retention were measured. The target values of the tensile strength retention and the tensile elongation retention are not less than 60%, respectively.

The tensile strength retention and the tensile elongation retention are calculated by following formulas (b) and (c).

$$\text{Tensile strength retention (\%)}\ (\text{tensile strength after the heat resistance test})\times 100/(\text{tensile strength before the heat resistance test}) \quad (b)$$

$$\text{Tensile elongation retention (\%)}=(\text{tensile elongation after the heat resistance test})\times 100/(\text{tensile elongation before the heat resistance test}) \quad (c)$$

(3) Oil Resistance Test

In accordance with JIS C-3005, after dipping the sample used for the initial tensile strength and tensile elongation tests in IRM-902 test oil heated at a temperature of 120° C. for 4 hours, the test oil was wiped off, and the sample was cooled at a room temperature for 4 hours. The tensile strength and tensile elongation tests were conducted for the sample thus cooled, and the tensile strength retention and the tensile elongation retention were measured. The target values of the tensile strength retention and the tensile elongation retention are not less than 80%, respectively.

(4) Flexibility Test

In accordance with JIS K-7171, the sample used for the initial tensile strength and tensile elongation tests was used as a test piece, and a concentrated load was applied on a center of the test piece held at both ends. The test piece was bent at a rate of 5 mm/min until the test piece is damaged or until a bent of the test piece reaches a predetermined level, and the load applied on the test piece during the test, namely, the bending elastic modulus was measured. The target value of the bending elastic modulus is not more than 20 MPa.

(5) Wiring Property Test

The insulated wire in each of the Examples and the Comparative examples was pushed into a gas pipe bent by an angle of 90', and a traversability (a smoothness for passing through the pipe) of the insulated wire was compared with that of a soft PVC coating insulated wire. When the traversability of the insulated wire in each of the Examples and the Comparative examples is equal to or more than that of the soft PVC coating insulated wire, an evaluation "O (accepted)" is given. When the traversability of the insulated wire in each of the Examples and the Comparative examples is less than that of the soft PVC coating insulated wire, an evaluation "X (rejected)" is given.

TABLE 1

| Items | | | Target value | EXAMPLES 1 | 2 | 3 | 4 | 5 | 6 | 7 |
|---|---|---|---|---|---|---|---|---|---|---|
| Composition (pbw) | Reactor type TPO-A | | — | 100 | — | — | 50 | 50 | — | 80 |
| | Reactor type TPO-B | | — | — | 100 | — | 50 | — | — | — |
| | Reactor type TPO-C | | — | — | — | 100 | — | 50 | 70 | — |
| | Reactor type TPO-D | | — | — | — | — | — | — | — | — |
| | Ethylene-vinyl acetate Copolymer | | — | — | — | — | — | — | 30 | — |
| | Random type polypropylene | | — | — | — | — | — | — | — | 20 |
| | Flame retardant agent | | — | 20 | 20 | 20 | 20 | 20 | 20 | 20 |
| | Antioxidant | | — | 1 | 1 | 1 | 1 | 1 | 1 | 1 |
| Evaluation result | Tensile strength (MPa) | | ≧13 | 13.8 | 14.6 | 15.4 | 14.2 | 14.6 | 13.2 | 15.5 |
| | Elongation (%) | | ≧300 | 550 | 380 | 320 | 430 | 400 | 380 | 340 |
| | Heat resistance property | Tensile strength retention (%) | ≧60 | 98 | 96 | 98 | 98 | 100 | 102 | 97 |
| | | Tensile elongation retention (%) | ≧60 | 92 | 88 | 98 | 88 | 96 | 88 | 92 |

TABLE 1-continued

| Items | | Target value | EXAMPLES 1 | 2 | 3 | 4 | 5 | 6 | 7 |
|---|---|---|---|---|---|---|---|---|---|
| Oil resistance property | Tensile strength retention (%) | ≧80 | 82 | 88 | 96 | 84 | 92 | 90 | 92 |
| | Tensile elongation retention (%) | ≧80 | 160 | 146 | 120 | 156 | 136 | 138 | 125 |
| Workability | Bending elastic modulus (MPa) | ≦20 | 14.6 | 18.5 | 19.0 | 17.4 | 18.2 | 17.2 | 19.2 |
| | Wiring property (Pipe traversability) | | ○ | ○ | ○ | ○ | ○ | ○ | ○ |

Examples 1 to 7

As shown in TABLE 1, 20 pbw of the flame retardant agent and 1 pbw of the antioxidant for 100 pbw of olefin-based polymer are added to each composition in the Examples 1 to 7.

In the Examples 1 to 3, only the reactor blended type polyolefin thermoplastic resin containing 51-85 mol % per monomer unit of the crystalline polypropylene is used.

In the Examples 4 and 5, a blended composition of two kinds of reactor blended type polyolefin thermoplastic resins each containing 51-85 mol % per monomer unit of the crystalline polypropylene is used. For example, in the Example 4, 50 pbw of the reactor blended type TPO-A is mixed with 50 pbw of the reactor blended type TPO-B.

In the Examples 6 and 7, a blended composition of a reactor blended type polyolefin thermoplastic resins containing 51-85 mol % per monomer unit of the crystalline polypropylene and another olefin-based polymer is used.

TABLE 2

| Items | | | Target value | COMPARATIVE EXAMPLES 1 | 2 | 3 | 4 | 5 | 6 | 7 | 8 | 9 |
|---|---|---|---|---|---|---|---|---|---|---|---|---|
| Composition (pbw) | Dynamically crosslinked type TPO | | — | 100 | — | — | — | — | | | — | — |
| | Reactor type TPO-D | | — | — | 100 | — | — | — | — | — | — | — |
| | Reactor type TPO-E | | — | — | — | 100 | — | — | — | — | — | — |
| | Linear low density polyethylene | | — | — | — | — | 50 | 30 | — | — | — | — |
| | Ethylene-vinyl acetate Copolymer | | — | — | — | — | — | — | 50 | 30 | 20 | 10 |
| | Random type polypropylene | | — | — | — | — | 50 | 70 | 50 | 70 | 80 | 90 |
| | Flame retardant agent | | — | 20 | 20 | 20 | 20 | 20 | 20 | 20 | 20 | 20 |
| | Antioxidant | | — | 1 | 1 | 1 | 1 | 1 | 1 | 1 | 1 | 1 |
| Evaluation result | Tensile strength (MPa) | | ≧13 | 14.2 | 13.1 | 15.6 | 14.2 | 15.4 | 13.4 | 13.8 | 14.4 | 15.6 |
| | Elongation (%) | | ≧300 | 380 | 580 | 330 | 320 | 230 | 360 | 310 | 280 | 240 |
| | Heat resistance property | Tensile strength retention (%) | ≧60 | 96 | 88 | 98 | 110 | 116 | 106 | 112 | 114 | 118 |
| | | Tensile elongation retention (%) | ≧60 | 86 | 88 | 96 | 72 | 64 | 78 | 72 | 66 | 62 |
| | Oil resistance property | Tensile strength retention (%) | ≧80 | 64 | 76 | 98 | 55 | 62 | 62 | 76 | 80 | 84 |
| | | Tensile elongation retention (%) | ≧80 | 220 | 170 | 120 | (*) | (*) | (*) | 205 | 188 | 176 |
| | Workability | Bending elastic modulus (MPa) | ≦20 | 21.5 | 14.0 | 21.2 | 24.1 | 28.3 | 22.5 | 26.4 | 29.2 | 33.1 |
| | | Wiring property (Pipe traversability) | | X | ○ | X | X | X | X | X | X | X |

(*) Not measurable

Comparative Examples 1 to 9

As indicated in TABLE 2, 20 pbw of the flame retardant agent and 1 pbw of the antioxidant for 100 pbw of the olefin-based polymer are added to each composition in the Comparative examples 1 to 9.

In the Comparative examples 1 to 3, only the polyolefin thermoplastic resin other than the reactor blended type polyolefin thermoplastic resin, or the reactor blended type polyolefin thermoplastic resin that does not contain 51-85 mol % per monomer unit of the crystalline polypropylene is used.

In the Examples 1 to 7, the reactor blended type polyolefin thermoplastic resin containing 51-85 mol % per monomer unit of the crystalline polypropylene is used. In the evaluation results of the heat resistance test, the oil resistance test, and the flexibility test, the target values are achieved for all tests. In addition, in the evaluation result of the wiring property, the evaluation "0" was given.

However, in the Comparative examples 1 to 9, the reactor blended type TPO containing 51-85 mol % per monomer unit of the crystalline polypropylene is not used. Therefore, the target values of the desired properties are not satisfied.

In the Comparative example 1 using only the dynamically crosslinked type TPO, the tensile strength retention in the oil resistance test is less than 800%, and does not satisfy the oil resistance In addition, the bending elastic modulus exceeds 20 MPa, so that the flexibility and the wiring property are not satisfied.

In the Comparative example 2 using the reactor blended type polyolefin thermoplastic resin containing less than 51 mol % per monomer unit of the crystalline polypropylene, the tensile strength retention in the oil resistance test is less than 80%, and does not satisfy the oil resistance.

In the Comparative example 3 using the reactor blended type polyolefin thermoplastic resin containing greater than 85 mol % per monomer unit of the crystalline polypropylene, the bending elastic modulus exceeds 20 MPa, so that the flexibility and the wiring property are not satisfied.

In the Comparative examples 4 to 9 using simple blended compositions of the linear low-density polyethylene, the random type polypropylene, and ethylene/vinyl acetate copolymer, respectively, the bending elastic modulus exceeds 20 Mpa for all samples, so that the flexibility and the wiring property are not satisfied.

In addition, in the Comparative examples 4 to 6, the tensile strength retention in the oil resistance test is low, and each sample surface was remarkably warped, so that it was impossible to measure the tensile elongation retention.

In the Comparative example 7, the tensile strength retention in the oil resistance test was low.

Next, Examples in the fourth to sixth preferred embodiments according to the present invention will be explained below.

TABLE 3 shows results of evaluation tests of compositions of insulator (resin compositions) in the Examples of the fourth to sixth preferred embodiment for respective properties.

TABLE 4 shows results of evaluation tests of compositions of insulator (resin compositions) in Comparative examples for respective properties.

Samples used in the evaluation tests are manufactured by extruding molding each of the resin compositions in the Examples shown in TABLE 3 and the resin compositions in the Comparative examples shown in TABLE 4, to have a sheet-like shape with a thickness of 2 mm. For each of these samples, an initial tensile strength test, an initial tensile elongation test, a heat resistance test, and an oil resistance test are conducted. Further, a flame retardant property evaluation test and a wiring property evaluation test are conducted for wires using samples.

Herein, each of flame retardant wires used in the flame retardant property evaluation test and the wiring property evaluation test has a structure shown in FIG. 1. Seven copper wires are stranded to have a total outer diameter of 3.6 mm to provide a metallic conductor 1, and the metallic conductor 1 is coated with the resin composition shown in TABLE 3 and TABLE 4 by extruding molding to provide a coating layer 2 with an outer diameter of 12 mm. The flame retardant property evaluation test and the wiring property evaluation test are conducted by using the flame retardant wire thus manufactured.

In TABLE 3 and TABLE 4, abbreviation and content of each composition is as follows.

TPO: Polyolefin-based thermoplastic resin

Reactor (blended) type TPO-A (density: 0.87 g/cm$^3$, MI (melt index): 7 g/10 min, crystalline polypropylene unit: 51 mol %)

Reactor type TPO-B (density: 0.87 g/cm$^3$, MI: 7 g/10 min, propylene unit: 63 mol %)

Reactor type TPO-C (density: 0.89 g/cm$^3$, MI: 7 g/10 min, propylene unit: 45 mol %)

Reactor type TPO-D (density: 0.89 g/cm$^3$, MI: 7 g/10 min, propylene unit: 90 mol %)

Linear low-density polyethylene (density: 0-92 g/cm$^3$, MI: 2 g/10 min)

Random type polypropylene (density: 0.90 g/cm$^3$, MI: 11 g/10 min)

Acrylonitrile butadiene rubber (bound acrylonitrile: 32%)

Flame retardant agent (magnesium hydrate, average grain size: 1.0 μm)

Antioxidant (phenolic based antioxidant)

Lubricant (fatty acid amide)

In addition, the measurements are conducted as follows in the evaluation tests shown in TABLE 3 and TABLE 4.

(1) Initial Tensile Strength and Tensile Elongation Tests

The initial tensile strength and tensile elongation tests were conducted similarly to those in the Examples 1 to 7 and the Comparative Examples 1 to 9.

(2) Heat Resistance Test

The heat resistance test was conducted similarly to that in the Examples 1 to 7 and the Comparative Examples 1 to 9.

(3) Oil Resistance Test

The oil resistance test was conducted similarly to that in the Examples 1 to 7 and the Comparative Examples 1 to 9.

(4) Flame Retardant Test

In accordance with JIS C-3005, the aforementioned flame retardant wire (a length of about 300 mm) was inclined with an angle of 60° with respect to a horizontal plane, and an upper end and a lower end of the flame retardant wire were held. A tip portion of an inner flame of a burner was applied to a position distant by about 20 mm from the lower end of the flame retardant wire, until the flame retardant wire burns within 30 seconds. After removing the burner, a degree of combustion is visually observed. As for the flame of the burner, the inner flame has a length of 35 mm and an outer flame has a length of 130 mm. When a self-extinction of the sample (without continuing the burning after removing the burner) is observed within 60 seconds, an evaluation "○ (accepted)" is given. When the sample continues to burn for more than 60 seconds after removing the burner, an evaluation "x (rejected)" is given.

(5) Wiring Property Test

The wiring property test was conducted similarly to that in the Examples 1 to 7 and the Comparative Examples 1 to 9.

TABLE 3

| Items | | | Target Value | EXAMPLES 8 | 9 | 10 | 11 | 12 | 13 | 14 | 15 | 16 |
|---|---|---|---|---|---|---|---|---|---|---|---|---|
| Composition (pbw) | Reactor type TPO-A | | — | 80 | 95 | — | 60 | 60 | 60 | 60 | 80 | — |
| | Reactor type TPO-B | | — | — | — | 95 | — | — | — | — | — | 80 |
| | Linear low density polyethylene | | — | — | — | — | 40 | 40 | 40 | 40 | — | — |
| | Random type polypropylene | | — | 20 | 5 | 5 | — | — | — | — | — | — |
| | Acrylonitrile butadiene rubber | | — | — | — | — | — | — | — | — | 20 | 20 |
| | Flame retardant agent | | — | 40 | 40 | 40 | 100 | 150 | 200 | 300 | 100 | 100 |
| | Antioxidant | | — | 1 | 1 | 1 | 1 | 1 | 1 | 1 | 1 | 1 |
| | Lubricant | | — | 1 | 1 | 1 | 1 | 1 | 1 | 1 | 1 | 1 |
| Evaluation result | Tensile strength (MPa) | | ≧13 | 13.8 | 13.0 | 14.3 | 14.6 | 15.4 | 15.8 | 13.5 | 14.6 | 13.2 |
| | Elongation (%) | | ≧300 | 550 | 620 | 600 | 380 | 350 | 330 | 310 | 400 | 380 |
| | Heat resistance property (100° C. × 96 h) | Tensile strength retention (%) | ≧60 | 98 | 99 | 100 | 96 | 98 | 96 | 98 | 100 | 102 |
| | | Tensile elongation retention (%) | ≧60 | 92 | 102 | 102 | 88 | 98 | 98 | 88 | 96 | 88 |
| | Oil resistance property (120° C. × 4 h) | Tensile strength retention (%) | ≧80 | 88 | 82 | 88 | 88 | 96 | 92 | 84 | 92 | 90 |
| | | Tensile elongation retention (%) | ≧80 | 160 | 180 | 142 | 146 | 120 | 132 | 156 | 136 | 138 |
| | Flame Retardant Property (JIS C3005) | 60° inclination | Self-extinction | ○ | ○ | ○ | ○ | ○ | ○ | ○ | ○ | ○ |
| | Workability | Wiring property (Pipe traversability) | | ○ | ○ | ○ | ○ | ○ | ○ | ○ | ○ | ○ |

Examples 8 to 16

As shown in TABLE 3, 1 pbw of the antioxidant and 1 pbw of the lubricant for 100 pbw of the olefin-based polymer are added to each composition in the Examples 8 to 16.

In the Examples 8 to 16, the reactor blended type polyolefin thermoplastic resin containing 51-85 mol % per monomer unit of the crystalline polypropylene is used.

For example, in the Example 8, a composition ratio of the insulative material is 80 pbw of the reactor type TPO-A, 20 pbw of the random type polypropylene and 40 pbw of the flame retardant agent.

TABLE 4

| Items | | Target Value | COMAPARATIVE EXAMPLES 10 | 11 | 12 | 13 | 14 | 15 |
|---|---|---|---|---|---|---|---|---|
| Composition (pbw) | Reactor type TPO-A | — | 50 | 100 | — | — | 95 | — |
| | Reactor type TPO-C | — | — | — | 95 | — | — | — |
| | Reactor type TPO-D | | — | — | — | 95 | — | 95 |
| | Linear low density polyethylene | — | 50 | — | — | — | — | — |
| | Random type polypropylene | — | — | — | 5 | 5 | 5 | 5 |
| | Flame retardant agent | — | 200 | 200 | 50 | 50 | 30 | 350 |
| | Antioxidant | — | 1 | 1 | 1 | 1 | 1 | 1 |
| | Lubricant | — | 1 | 1 | 1 | 1 | 1 | 1 |

TABLE 4-continued

| Items | | | Target Value | COMAPARATIVE EXAMPLES 10 | 11 | 12 | 13 | 14 | 15 |
|---|---|---|---|---|---|---|---|---|---|
| Evaluation result | Tensile strength (MPa) | | ≧13 | 14.6 | 12.0 | 14.2 | 15.6 | 13.6 | 15.4 |
| | Elongation (%) | | ≧300 | 400 | 660 | 600 | 330 | 560 | 280 |
| | Heat resistance property (100° C. × 96 h) | Tensile strength retention (%) | ≧60 | 98 | 98 | 96 | 98 | 100 | 95 |
| | | Tensile elongation retention (%) | ≧60 | 98 | 102 | 98 | 96 | 102 | 86 |
| | Oil resistance property (120° C. × 4 h) | Tensile strength retention (%) | ≧80 | 78 | 76 | 72 | 98 | 85 | 86 |
| | | Tensile elongation retention (%) | ≧80 | 158 | 210 | 220 | 120 | 165 | 150 |
| | Flame Retardant Property (JIS C3005) | 60° inclination | Self-extinction | ○ | ○ | ○ | ○ | X | ○ |
| | Workability | Wiring property (Pipe traversability) | | ○ | ○ | ○ | X | ○ | X |

Comparative Examples 10 to 15

As indicated in TABLE 4, 1 pbw of the antioxidant and 1 pbw of the lubricant for 100 pbw of the olefin-based polymer are added to each composition in the Comparative examples 10 to 15.

In the Examples 8 to 16, the target values are achieved for all the evaluation results of the heat resistance test and the oil resistance test. In addition, for all the evaluation results of the flame retardant property and the wiring property, the evaluations "○" were given.

However, in the Comparative examples 10 to 15, the target values of the desired properties are not satisfied.

In the Comparative examples 10 and 11, 50 pbw and 100 pbw of the reactor blended type polyolefin thermoplastic resin for 100 pbw of the blended composition are used, respectively. The tensile strength retention in the oil resistance test is less than 80%, and the oil resistance is not satisfied.

In the Comparative example 12 using the reactor blended type polyolefin thermoplastic resin containing less than 51 mol % per monomer unit of the crystalline polypropylene, the tensile strength retention in the oil resistance test is less than 80%, and does not satisfy the oil resistance.

In the Comparative example 13 using the reactor blended type polyolefin thermoplastic resin containing greater than 85 mol % per monomer unit of the crystalline polypropylene, the flame retardant property and the wiring property are not satisfied.

In the Comparative example 14, the flame retardant agent is not within the range of 40 to 300 pbw, and the flame retardant property is not satisfied.

In the Comparative examples 15 using the reactor blended type polyolefin thermoplastic resin which does not contain 51-85 mol % per monomer unit of the crystalline polypropylene, in which the flame retardant agent is not within the range of 40 to 300 pbw, the wiring property is not satisfied.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. An insulated wire comprising:

a metallic conductor; and an insulator provided at an outer periphery of the metallic conductor for coating the metallic conductor, the insulator comprising a reactor blended type polyolefin-based thermoplastic resin containing 51-85 mol % per monomer unit of a crystalline polypropylene.

2. The insulated wire according to claim 1, wherein a bending elastic modulus of the insulator is not more than 20 MPa.

3. The insulated wire according to claim 1, wherein the insulator further comprises an olefin-based polymer blended with the reactor blended type polyolefin-based thermoplastic resin.

4. The insulated wire according to claim 1, further comprising a sheath layer for coating an outer periphery of the insulator.

5. The insulated wire according to claim 4, wherein the metallic conductor comprises a plurality of metallic conductors each coated with the insulator and stranded with each other.

6. An insulated cable comprising:

a metallic conductor; and an insulator provided at an outer periphery of the metallic conductor for coating the metallic conductor, the insulator comprising a reactor blended type polyolefin-based thermoplastic resin containing 51-85 mol % per monomer unit of a crystalline polypropylene.

7. The insulated cable according to claim 1, wherein a bending elastic modulus of the insulator is not more than 20 MPa.

8. The insulated cable according to claim 1, wherein the insulator further comprises an olefin-based polymer blended with the reactor blended type polyolefin-based thermoplastic resin.

9. The insulated cable according to claim 6, further comprising a sheath layer for coating an outer periphery of the insulator.

10. The insulated cable according to claim 9, wherein the metallic conductor comprises a plurality of metallic conductors each coated with the insulator and stranded with each other.

11. A non-halogen flame retardant wire comprising:

a metallic conductor; and an insulator provided at an outer periphery of the metallic conductor for coating the metallic conductor, the insulator comprising 100 pbw of a blended composition and 40 to 300 pbw of a metallic hydroxide, the blended composition comprising greater than 50 pbw and less than 100 pbw of a reactor blended type polyolefin-based thermoplastic resin containing 51-85 mol % per monomer unit of a crystalline polypropylene, and greater than 0 pbw and not greater than 50 pbw of a polyolefin.

12. The non-halogen flame retardant wire according to claim 11, wherein the reactor blended type polyolefin-based resin is 60 to 90 pbw and the polyolefin is 5 to 40 pbw in the blended composition.

13. The non-halogen flame retardant wire according to claim 11, wherein the polyolefin comprises at least one of a crystalline rubber and a polar rubber.

14. The non-halogen flame retardant wire according to claim 11, further comprising a sheath layer for coating an outer periphery of the insulator.

15. The non-halogen flame retardant wire according to claim 14, wherein the metallic conductor comprises a plurality of metallic conductors each coated with the insulator and stranded with each other.

16. A non-halogen flame retardant cable comprising:

a metallic conductor; and an insulator provided at an outer periphery of the metallic conductor for coating the metallic conductor, the insulator comprising 100 pbw of a blended composition and 40 to 300 pbw of a metallic hydroxide, the blended composition comprising greater than 50 pbw and less than 100 pbw of a reactor blended type polyolefin-based thermoplastic resin containing 51-85 mol % per monomer unit of the crystalline polypropylene, and greater than 0 pbw and not greater than 50 pbw of a polyolefin.

17. The non-halogen flame retardant cable according to claim 16, wherein the reactor blended type polyolefin-based resin is 60 to 90 pbw and the polyolefin is 5 to 40 pbw in the blended composition.

18. The non-halogen flame retardant cable according to claim 16, wherein the polyolefin comprises at least one of a crystalline rubber and a polar rubber.

19. The non-halogen flame retardant cable according to claim 16, further comprising a sheath layer for coating an outer periphery of the insulator.

20. The non-halogen flame retardant cable according to claim 19, wherein the metallic conductor comprises a plurality of metallic conductors each coated with the insulator and stranded with each other.

* * * * *